US005774835A

United States Patent [19]

Ozawa

[11] Patent Number: 5,774,835

[45] Date of Patent: Jun. 30, 1998

[54] METHOD AND APPARATUS OF POSTFILTERING USING A FIRST SPECTRUM PARAMETER OF AN ENCODED SOUND SIGNAL AND A SECOND SPECTRUM PARAMETER OF A LESSER DEGREE THAN THE FIRST SPECTRUM PARAMETER

[75] Inventor: Kazunori Ozawa, Tokyo, Japan

[73] Assignee: NEC Corporation, Tokyo, Japan

[21] Appl. No.: 517,357

[22] Filed: Aug. 21, 1995

[30] Foreign Application Priority Data

Aug. 22, 1994 [JP] Japan ..... 6-196563

[51] Int. Cl.[6] ..... G10L 5/00; G10L 9/02; G10L 7/02

[52] U.S. Cl. ..... 704/205; 704/269; 704/216; 704/217; 704/219; 704/226; 704/228; 704/229

[58] Field of Search ..... 395/2.12, 2.25, 395/2.26, 2.28, 2.35, 2.37, 2.38, 2.71, 2.78; 704/205, 219, 220

[56] References Cited

U.S. PATENT DOCUMENTS

| | | | |
|---|---|---|---|
| 4,716,592 | 12/1987 | Ozawa et al. | 704/216 |
| 4,969,192 | 11/1990 | Chen et al. | 381/31 |
| 4,991,215 | 11/1989 | Taguchi | 381/38 |
| 5,307,441 | 4/1994 | Tzeng | 704/222 |

FOREIGN PATENT DOCUMENTS 64-13200 1/1989 Japan .

OTHER PUBLICATIONS

Gerson et al., "Vector Sum Excited Linear Prediction (VSELP) Speech Coding At 8 KBPS", *IEEE*, pp. 461–4464, (1990).

Chen et al., "Real–Time Vector APC Speech Coding At 4800 BPS With Adaptive Postfiltering", *IEEE*, pp. 2185–2188, (1987).

Yelender,s. et al. "Low bit rate speech coding at 1.2 and 2.4 Kb/s." IEEE colloq. speech coding technique and application, 1992.

Hongmei Ai et al. "A 6.6 Kb/s CELP speech coder: high performance for GSM half–rate system." speech image processing, and neural networks, int'l symposium, 1994.

*Primary Examiner*—David R. Hudspeth
*Assistant Examiner*—Daniel Abebe
*Attorney, Agent, or Firm*—Foley & Lardner

[57] ABSTRACT

A second spectrum parameter of which degree is lower than that of a first spectrum parameter is calculated based on the first spectrum parameter that is output from an encoder. A spectrum postfilter generates a transfer function having a denominator and a numerator wherein said first spectrum parameter is included in said denominator and said second spectrum parameter is included in said numerator, and filters the reduced signal with this transfer function. In addition, it adaptively generates a compensation coefficient based on the first and second parameters. A compensation filter generates a transfer function based the compensation coefficient and filters an output of the spectrum postfilter with this transfer function.

20 Claims, 2 Drawing Sheets

METHOD AND APPARATUS OF POSTFILTERING USING A FIRST SPECTRUM PARAMETER OF AN ENCODED SOUND SIGNAL AND A SECOND SPECTRUM PARAMETER OF A LESSER DEGREE THAN THE FIRST SPECTRUM PARAMETER

BACKGROUND OF THE INVENTION

This invention relates to a postfilter and, more particularly, to the one used for reproducing encoded voice signals with excellent quality at a low bit rate, especially 4.8 kb/s or lower.

Encoding a voice signal at a low bit rate may increasingly produce quantized noise, leading to deteriorating voice quality. A postfilter which has been used at a receiver side is a well-known device to improve perceptual S/N (signal to noise) ratio of the reproduced voice for excellent tone quality.

An encoded voice signal is reproduced by a decoder, then the output from which is output to the postfilter to provide a signal with improved tone quality.

The postfilter generally comprises a pitch postfilter, a spectrum postfilter and a compensation filter.

The specific construction of the postfilter has been introduced in a paper titled "Real-time vector APC speech coding at 4800 bps with adaptive postfiltering", Chen et al., IEEE Proceedings ICASSP, 1987, pp.2185–2188, or disclosed in Publication of Japanese Patent Laid Open No.13200(1989) by Chen. Comprehensive transfer characteristics of a postfiltering used in a conventional manner may be represented by the following equation (1) after Z coordinate conversion.

$$H(z)=H_p(z)\cdot H_s((z)\cdot H_t(z) \tag{1}$$

where Hp(z), Hs(z), Ht(z) represent transfer characteristics of a pitch postfilter, a spectrum postfilter, and a compensation filter, respectively.

The transfer characteristic Hp(z) of the pitch postfilter is derived from the following equation (2).

$$H_p(z)=[1+\gamma z^{-T}]/[1-\lambda z^{-T}] \tag{2}$$

Where $\gamma$ and $\lambda$ are weighting coefficients and T denotes a delay of adaptive codebook.

A codebook has been designed in which a table showing a relationship between T and a linear predictive coefficient value (described later) ai in relation with a time frame (for example, 20 msec.) is recorded.

The transfer characteristic of the spectrum postfilter, Hs(z), is generally of ARMA (Autoregressive moving-average) type, represented by the following equation (3).

$$H_s(z)=\left[1-\sum_{i=1}^{P} a_i\gamma_1^i z^{-i}\right]/\left[1-\sum_{i=1}^{P} a_i\gamma_2^i z^{-i}\right] \tag{3}$$

where ai and p denote a linear predictive coefficient and degrees of a spectral parameter, respectively.

Conventionally the degree p may be selected to take a value 10. The codes $\gamma_1$ and $\gamma_2$ denote weighting coefficients which are so selected to be $0<\gamma_1<\gamma_2<1$.

The transfer characteristic of the compensation filter, Ht(z), is derived from the following equation (4).

$$H_t(z)=1-\eta\cdot z^{-1} \tag{4}$$

where the coefficient $\eta$ is so selected to be $0<\eta<1$.

On pp.461 to 464, the paper submitted to IEEE, Proceedings ICASSP, 1990, discloses on the postfilter using both pitch postfilter and spectrum postfilter with their characteristics represented by the following equations rather than those of the aforementioned pitch postfilter and the spectrum postfilter.

The characteristic of the pitch postfilter, Hp(z), may be derived from the following equation (5).

$$H_p(z)=1/[1-\lambda\beta z^{-T}] \tag{5}$$

where the code $\beta$ is a gain of the adaptive codebook.

The transfer characteristic of the spectrum postfilter, Hs(z), may be derived from the following equation (6).

$$H_s(z)=\left[1-\sum_{i=1}^{p} b_i z^{-i}\right]/\left[1-\sum_{i=1}^{p} a_i\gamma_2^i z^{-i}\right] \tag{6}$$

where the numerator of the right side of the above equation (6) serves to cancel spectral tilt by the denominator.

Conventionally an impulse response of the degree p filter of the denominator is obtained. The obtained impulse response is converted into the degree p autocorrelation function, which is multiplied by a lag window thereon for smoothing. Then the autocorrelation function is solved to obtain a value of bi, the degree p coefficient.

The lag window represented by w(i) in the following equation denotes a weighting coefficient to be multiplied by the autocorrelation function.

The autocorrelation function R'(i) after being multiplied by the lag window can be represented by the following equation in relation with the autocorrelation function R(i) before being multiplied by the lag window;

$$R'(i)=w(i)\cdot R(i)$$

where i=1–p.

Among conventional postfilters as aforementioned, the spectrum postfilter represented by the equation (3) has the following defects.

The first defect is that more arithmetic operations have to be executed because both numerator and denominator require the degree (2×p) filtering. The second defect is that there is the spectral tilt of widely ranged drop type in case of the frame with higher predictive gain such as a vowel part. So the numerator filter fails to sufficiently cancel the spectral tilt characteristic of the filter at the denominator of the equation (3) owing to transfer characteristic Hs(z) of the spectrum postfilter.

The compensation filter with its transfer characteristic represented by the equation (4) has been used to eliminate the tilt. The weighting coefficient value is kept constant on a regular basis and set irrespective of the tilt amount.

Thus the postfilter as a whole fails to eliminate sufficient amount of the spectral tilt, resulting in the tilt of widely ranged drop type. Applying the postfilter to the reproduced voice may suppress the quantized noise. The resultant tone quality, however, lacks clearness. Conversely increasing the value of $\eta$ in the compensation filter may unnecessarily intensify high tone range thereby, especially in a section where a consonant part and peripheral noise are convoluted because of less amount of spectral tilt. As a result, the reproduced voice may become unnatural.

The transfer characteristic of the spectrum postfilter represented in the equation (6) is added to that for the pitch postfilter represented in the equation (5) for coping with the above drawback.

The postfilter with those transfer characteristics added thereto is able to eliminate the spectral tilt of the denominator to some extent by the numerator of the equation (6). However, it cannot eliminate the spectral tilt to the satisfactory level, thus remaining the tilt characteristic of Hs(z) as a whole.

As a result, the above postfilter has the same drawback as that of the spectrum postfilter having transfer characteristic of the equation (3).

The postfilter including the spectrum postfilter with transfer characteristic of the equation (6) has a drawback to demand increased amount of arithmetic operations in order to solve the degree p (usually degree 10) autocorrelation.

SUMMARY OF THE INVENTION

It is an object of the present invention to provide an excellent reproduced sound quality of a sound signal that was coded at a low bit rate.

It is another object of the present invention to adaptively and accurately remove a tilt amount of a spectrum that is generated in a spectrum postfilter.

It is a further object of the present invention to reduce amount of calculation in the postfilter.

The above objects are achieved by a postfilter for reproducing a sound signal, which was encoded with an encoder, using a decoder and compensating a reproduced signal, the postfilter comprising: first calculating means for calculating a second spectrum parameter based on a first spectrum parameter supplied from the encoder, wherein the degree of second spectrum parameter is lower than that of the first spectrum parameter; a spectrum postfilter for generating a first transfer function having a denominator and a numerator wherein the first spectrum parameter is included in the denominator and the second spectrum parameter is included in the numerator, and filtering the reproduced signal based on the first transfer function; second calculating means for adaptively calculating a compensation coefficient based on the first spectrum parameter and the second spectrum parameter; and a compensation filter for generating a second transfer function based on the compensation coefficient and filtering an output of the spectrum postfilter based on the second transfer function.

Furthermore, the above objects are achieved by a method of postfiltering for reproducing a sound signal, which was encoded with an encoder, using a decoder and postfiltering a reproduced signal, the method of postfiltering comprising steps of: sampling a preset sampling number of first spectrum parameter from the encoder; sampling a preset sampling number of the reproduced signal; calculating a second spectrum parameter of which degree is lower than that of the sampled first spectrum parameter; first filtering for generating a first transfer function having a denominator and a numerator wherein the first spectrum parameter is included in the denominator and the second spectrum parameter is included in the numerator and filtering the sampled reproduced signal based on the first transfer function; adaptively calculating a compensation coefficient based on the sampled first spectrum parameter and the second spectrum parameter; and second filtering for generating a second transfer function based on the compensation coefficient and filtering a signal filtered in the first filtering step based on the second transfer function.

The postfilter of the present invention generates a second spectrum parameter of which degree is lower than that of a first spectrum parameter, in accordance with a value of the first spectrum parameter.

Similarly to this, the compensation coefficient is modified according to the values of the first spectrum parameter and the second spectrum parameter and filtered. As a result, it enables to eliminate spectral tilt which has been occurred in the spectrum postfilter accurately and adaptively compared with the prior art. This postfilter, thus, has an effect of improving clearness of the reproduced sound quality.

In addition, the present invention enables to make amount of calculation for processing in a postfilter smaller than the prior art.

BRIEF DESCRIPTION OF THE DRAWINGS

This and other objects, features and advantages of the present invention will become more apparent upon a reading of the following detailed description and drawings, in which.

DESCRIPTION OF THE PREFERRED EMBODIMENTS

Embodiments of the present invention are explained, referring to figures.

Figure 1:
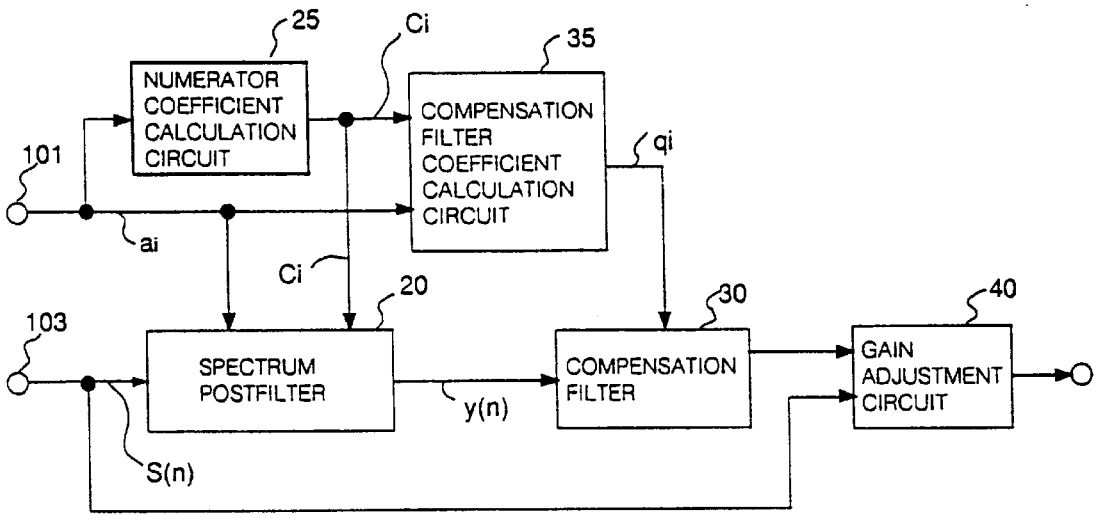
FIG. 1 is a block diagram showing a first embodiment of a postfilter of the present invention.

FIG. 1 is a block diagram showing a first embodiment of a postfilter of the present invention.

It is to be noted that a well-known linear predictive coefficient is used as a spectrum parameter for the embodiments.

In this figure, the numeral 25 denotes a numerator coefficient calculation circuit for inputting a linear predictive coefficient ai output from an encoder (not shown) for encoding a voice data, and calculating a linear predictive coefficient ci that is a numerator coefficient. The above-mentioned encoder is used for encoding the voice data.

The numeral 35 is a compensation filter coefficient calculation circuit for inputting the linear predictive coefficient ai and the linear predictive coefficient ci, and calculating a compensation coefficient.

The numeral 20 is a spectrum postfilter for generating a transfer function based on the linear predictive coefficient ai output from the encoder (not shown) and an output of the numerator coefficient calculation circuit 25. Then, it postfilters a reproduce signal S(n) from a decoder (not shown) based on the generated transfer function.

In addition, the postfilter of FIG. 1 comprises a compensation filter 30 for inputting an output of the spectrum postfilter 20 and an output of the compensation filter coefficient calculation circuit 35, and a gain adjustment circuit 40 for inputting an output of the compensation filter 30.

In the postfilter of FIG. 1, the linear predictive coefficient ai (i=1−p, where p is a number of degree) and the reduced signal S(n) are input to the input terminals 101 and 103 respectively at every preset time interval (5 ms to 10 ms, for example).

It is assumed that the degree p of the linear predictive coefficient ai (i=1−p) is 10, hereinafter.

The numerator coefficient calculation circuit 25 inputs the 10 degree's linear predictive coefficient ai and calculates the linear predictive coefficient ci (i=1−M) of which degree is M (M is 1 or more and smaller enough than p).

Figure 2:
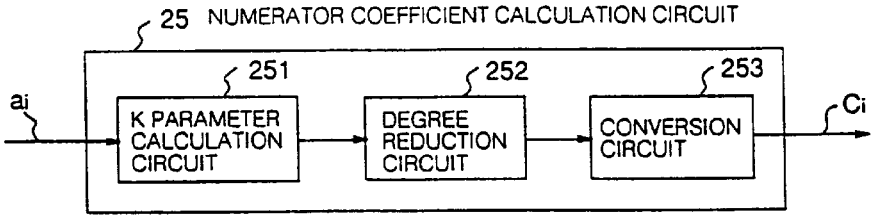
FIG. 2 is a block diagram showing an embodiment of a detailed construction of a numerator coefficient calculation circuit.

FIG. 2 is a block diagram showing a detailed construction of the numerator coefficient calculation 25 shown in FIG. 1.

The numerator coefficient calculation 25 in FIG. 2 comprises a k parameter calculation circuit 251 for inputting 10 degree's linear predictive coefficient ai and outputting a k parameter, and a degree reduction circuit 252 for inputting the k parameter and reducing k parameter's degree to M, and a conversion circuit 253 for calculating and outputting the linear predictive coefficient ci based on an output of the degree reduction circuit 252.

Using a following well-known equations (7) and (8), the k parameter calculation circuit 251 firstly converts 10 degree's linear predictive coefficient ai to a 10 degree's k parameter.

$$k_m=-\alpha_m \tag{7}$$

$$\alpha_i^{(m-1)}=[\alpha_i^{(m)}-\alpha_m^{(m)}\alpha_{m-i}^{(m)}]/[1-k_m^2] \tag{8}$$

Processing of equations (7) and (8) is repeated in order as m=p, p−1, . . . , 2, 1.

Next, the degree reduction circuit 252 reduces the degree of k parameter of which degree is 10. That is, M parameters are extracted from among 10 k parameters.

Following the equations (9) and (10), the conversion circuit 253 converts M degree k parameters to a linear predictive coefficient ci (i=1−M).

$$c_m=-k_m \tag{9}$$

$$c_i^{(m)}=[c_i^{(m-1)}-k_m c_{m-1}^{(m-1)}](1\leqq i\leqq m-1) \tag{10}$$

Through repetition calculations in order as i=1, 2, . . . , M, cm (where, m=1−M) is obtained and output to the spectrum postfilter 20 and the compensation filter coefficient circuit 35.

The spectrum postfilter 20 inputs the linear predictive coefficient ai (where, i=1−p) and ci (where, i=1−M) and generates a transfer function Hs(z) of the following equation (11). Where, the type of the transfer function Hs(z) of the spectrum postfilter is the same ARMA type as that of prior art.

$$H_s(z)=\left[1-\sum_{i=1}^{M} c_i\gamma_1^i z^{-i}\right]/\left[1-\sum_{i=1}^{P} a_i\gamma_2^i z^{-i}\right] \tag{11}$$

As the equation (11) shows, the filter degrees of the denominator and the numerator of the transfer function Hs(z) are different each other for reducing an amount of filtering calculation in the spectrum postfilter. In this embodiment, it is supposed that the degree p of the denominator is 10, and that of the numerator is 1 or more and smaller enough than p (where, 10).

Accordingly, this embodiment shows that the amount of calculation of the equation (11) is smaller than that of equation (6), furthermore, the smaller M the smaller amount of calculation, because degree of the numerator of the equation (11) is small and calculation by autocorrelation method is not necessary, while the bi in the above-mentioned equation (6) needs it.

Next, the spectrum postfilter 20 postfilters the reproduced signal S(n) according to the following equation (12).

$$y(n)=s(n)-\sum_{i=1}^{M} c_i\gamma_1^i S(n-i)+\sum_{i=1}^{p} a_i\gamma_1^i y(n-i) \tag{12}$$

Here, for the values of weighting coefficients in the equation (12), $\gamma_1$ and $\gamma_2$, are set in the range of $0<\gamma_1<\gamma_2<1$.

The spectrum postfilter 20 postfilters the reproduced signal S(n) that is reduced and output with the decoder (not shown), and outputs a result to the compensation filter 30

Figure 3:
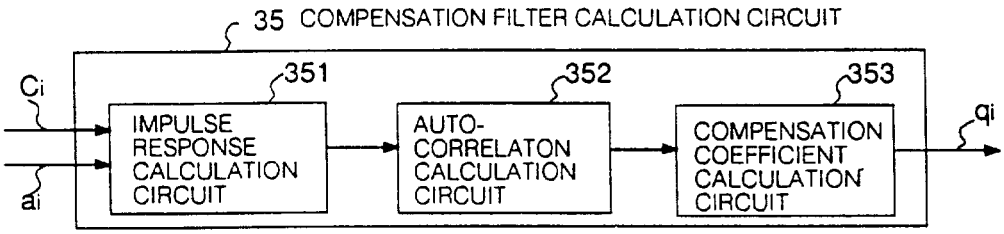
FIG. 3 is a block diagram showing an embodiment of a detailed construction of a compensation filter coefficient calculation circuit.

FIG. 3 is a block diagram showing a detailed embodiment of the compensation filter coefficient calculation circuit 35 shown in FIG. 1.

The compensation filter coefficient calculation circuit 35 in FIG. 3 comprises an impulse response calculation circuit 351 for inputting the linear predictive coefficient ai and the linear predictive coefficient ci and calculating an impulse response of the spectrum postfilter, and the autocorrelation function calculation circuit 352 for calculating and outputting a autocorrelation function, and a compensation coefficient calculation circuit 353 for calculating and outputting an L degree compensation coefficient qi based on this autocorrelation function.

Based on the linear predictive coefficient ai, the impulse response calculation circuit 351 calculates an impulse response hw(n) of a spectrum postfilter having a transfer function of the equation (11) for a preset sampling number Q (where, Q is 20 or 40).

The autocorrelation function calculation circuit 352 receives an output of the impulse response calculation circuit 351 and calculates according to the following equation (13) to obtain an L degree autocorrelation function R(m).

$$R(m)=\sum_{n=0}^{Q-1-m} h_w(n)h_w(n+m)\ (0\leqq m\leqq L) \tag{13}$$

Based on an output of the autocorrelation function calculation circuit 352, the compensation coefficient calculation circuit 353 calculates according to the well-known autocorrelation method to obtain and output an L degree compensation coefficient qi (where, i=1−L).

It is possible to suppose that L is 1. If L is 1, it is easy as below to obtain the compensation coefficient qi using the following equation (14).

$$q_1=R(1)/R(0) \tag{14}$$

Where, degree of R(0) and R(1) are o and 1, respectively.

It is to be noted that if supposing that L=1 it is possible to obtain a sufficient performance, because the spectrum tilt of whole Hs(z) is not so big.

For adaptively eliminating a spectrum tilt of whole Hs(z) based on the above-mentioned compensation coefficient qi, the compensation filter 30 generates a transfer function of the following equation (15).

$$H_t(z)=1-\sum_{i=1}^{L} \epsilon_i q_i z^{-i} \tag{15}$$

Were, qi and L are a compensation coefficient and a degree, respectively. L is 1 or more and smaller enough than p (10, in this embodiment). In addition, $\epsilon i$ is a preset weighting coefficient and the value is larger than 0 and smaller than 1.

The compensation filter 30 processes an output of the spectrum filter 20 according to the following equation (16) and outputs a result.

$$g(n)=y(n)-\sum_{i=1}^{L} \epsilon_i q_i y(n-1) \tag{16}$$

Where, g(n) is an output signal of the compensation filter 30 and y(n) is an input signal.

The gain adjustment circuit 40 adjust a gain so as to equal power of the reproduced signal S(n) of an external decoder (not shown) to that of output thereof.

Next, the second embodiment is explained.

In the second embodiment, a filter coefficient calculation circuit 45 is added to the first embodiment.

Figure 4:
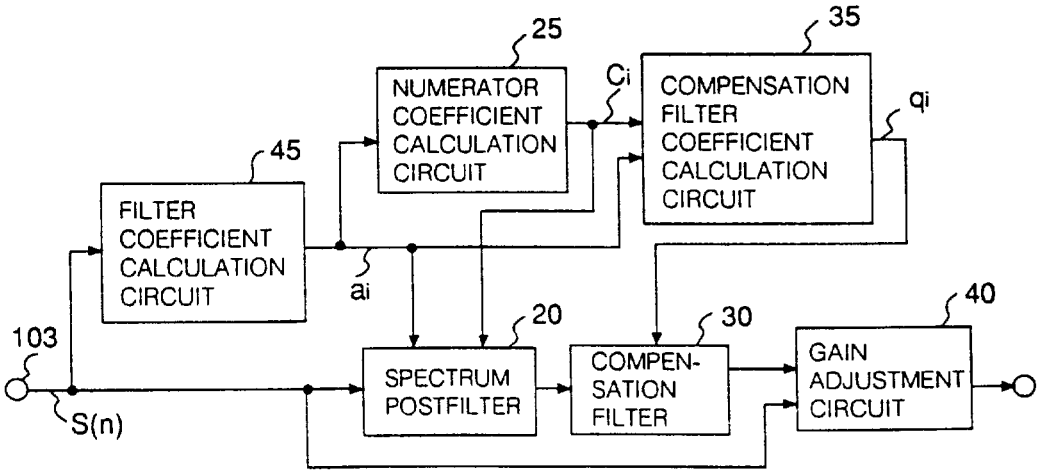
FIG. 4 is a block diagram showing a second embodiment of a postfilter of the present invention.

FIG. 4 shows a block diagram of the second embodiment.

In FIG. 4, operations of a numerator coefficient calculation circuit 25, a compensation filter coefficient calculation circuit 35, a spectrum postfilter 20, a compensation filter 30 and a gain adjustment circuit 40 are the same those in FIG. 1, so the explanations are omitted.

The filter coefficient calculation circuit 45 accumulates the reproduced signal S(n) for a preset sampling number. More, it calculates p degree autocorrelation function from the accumulated reproduced signal S(n)'s, obtains a p degree linear predictive coefficient (where, i=1−p) using autocorrelation method and outputs a result to the numerator coefficient calculation circuit 25, the spectrum postfilter 20 and the compensation filter calculation circuit 35.

Continuously, the same processing as the first embodiment is performed.

Although a linear predictive coefficient is used as a spectrum parameter in the first and second embodiments, it is possible to other well-known coefficient instead.

In addition, the compensation coefficient qi is calculated using autocorrelation method in the above embodiments. It is, however, better to obtain the same using other well-known methods to approximate a transfer characteristics of a spectrum postfilter.

Using FFT (Fast Fourier transformation), for example, it is better to obtain a frequency spectrum Hz(z), calculate an impulse response of a compensation filter by performing inverse Fourier transformation to the result and calculate a compensation coefficient of the compensation filter based on the calculated result.

Additionally, the compensation filter 30 in the above embodiment has the equation (15) as a transfer function, it may have other types of transfer function. For example, it is possible to give an ARMA type transfer function as a transfer characteristic to the compensation filter 30.

In the above explanation, although a pitch postfilter was not explained, the construction of postfilter of the present invention may include the pitch postfilter. In this case, it is possible to use a pitch postfilter that is disclosed in the above-mentioned Japanese Patent Laid-open No.13200 (1989) or one that has a transfer characteristic shown by the equation (5).

In addition, the coefficient of the pitch postfilter can be calculated from a reproduced signal.

What is claimed is:

1. A postfilter for reproducing a sound signal that has been encoded with an encoder, by using a decoder and compensating a reproduced signal that was output from said decoder, said postfilter comprising:

first calculating means for calculating a second spectrum parameter based on a first spectrum parameter supplied from said encoder, said first spectrum parameter being related to said sound signal encoded by said encoder, wherein the degree of said second spectrum parameter is lower than that of said first spectrum parameter;

a spectrum postfilter for generating a first transfer function having a denominator and a numerator, wherein said first spectrum parameter is included in said denominator and said second spectrum parameter is included in said numerator, said spectrum postfilter receiving said reproduced signal output from said decoder and filtering said reproduced signal based on said first transfer function;

second calculating means for adaptively calculating a compensation coefficient based on said first spectrum parameter and said second spectrum parameter; and a compensation filter for generating a second transfer function based on said compensation coefficient and filtering an output of said spectrum postfilter based on said second transfer function, wherein an output of said compensation filter that corresponds to a filtered reproduced signal is a reproduction of said sound signal.

2. The postfilter of claim 1, further comprising:

said first calculating means for inputting a first linear predictive coefficient as said first spectrum parameter and calculating a second linear predictive coefficient of which degree is lower that that of said first linear predictive coefficient; and said second calculating means for calculating said compensation coefficient based on said first linear predictive coefficient and said second linear predictive coefficient.

3. The postfilter of claim 1, comprising said spectrum postfilter for generating a transfer function of autoregressive moving average type.

4. The postfilter of claim 1, wherein said first calculating means further comprises:

means for converting said first spectrum parameter to preset k parameters;

means for extracting an arbitrary k parameter from among said k parameters; and means for converting said extracted k parameter to a second spectrum parameter.

5. The postfilter of claim 1, wherein said second calculating means further comprises:

means for calculating an impulse response of said spectrum postfilter based on said first spectrum parameter and said second spectrum parameter;

means for calculating a preset autocorrelation function based on said calculated impulse response; and means for calculating said compensation coefficient based on said calculated autocorrelation function.

6. The postfilter of claim 1, further comprising spectrum parameter calculating means for calculating a spectrum parameter in accordance with said reproduced signal, wherein said first calculating means comprising means for inputting said calculated spectrum parameter, instead of said first spectrum parameter, and calculating a spectrum parameter of which degree is lower than that of said calculated spectrum parameter.

7. A postfilter for reproducing a sound signal that has been encoded with an encoder, by using a decoder and compensating a reproduced signal that was output from said decoder, said postfilter comprising:

means for converting a first linear predictive coefficient supplied from said encoder to preset k parameters, said first linear predictive coefficient being related to said sound signal encoded by said encoder;

means for extracting an arbitrary k parameter from among said k parameters;

means for converting said extracted k parameter to a second linear predictive coefficient, wherein the degree of said second linear predictive coefficient is lower than that of said first linear predictive coefficient;

a spectrum postfilter for generating a first transfer function of autoregressive moving average type having a denominator and a numerator, wherein said first spectrum parameter is included in said denominator and said second spectrum parameter is included in said numerator, said spectrum postfilter receiving said reproduced signal output from said decoder and filtering said reproduced signal based on said first transfer function;

means for calculating an impulse response of said spectrum postfilter based on said first linear predictive coefficient and said second linear predictive coefficient;

means for calculating a preset autocorrelation function based on said calculated impulse response;

means for calculating said compensation coefficient based on said calculated autocorrelation function; and a compensation filter for generating a second transfer function based on said compensation coefficient and filtering an output of said spectrum postfilter based on said second transfer function, wherein an output of said compensation filter that corresponds to a filtered reproduced signal is a reproduction of said sound signal.

8. A postfilter for reproducing a sound signal that has been encoded with an encoder, by using a decoder and compensating a reproduced signal that was output from said decoder, said postfilter comprising:

means for calculating a first linear predictive coefficient in accordance with said reproduced signal received from said decoder;

means for converting a first linear predictive coefficient to preset k parameters;

means for extracting an arbitrary k parameter from among said k parameters;

means for converting said extracted k parameter to a second linear predictive coefficient, wherein the degree of said second linear predictive coefficient is lower than that of said first linear predictive coefficient;

a spectrum postfilter for generating a first transfer function of autoregressive moving average type having a denominator and a numerator, wherein said first spectrum parameter is included in said denominator and said second spectrum parameter is included in said numerator, said spectrum postfilter receiving said reproduced signal output from said decoder and filtering said reproduced signal based on said first transfer function;

means for calculating an impulse response of said spectrum postfilter based on said first linear predictive coefficient and said second linear predictive coefficient;

means for calculating a preset autocorrelation function based on said calculated impulse response;

means for calculating said compensation coefficient based on said calculated autocorrelation function; and a compensation filter for generating a second transfer function based on said compensation coefficient and filtering an output of said spectrum postfilter based on said second transfer function, wherein an output of said compensation filter that corresponds to a filtered reproduced signal is a reproduction of said sound signal.

9. A method of postfiltering for reproducing a sound signal that has been encoded with an encoder, by using a decoder and postfiltering a reproduced signal that was output from said decoder, said method of postfiltering comprising the steps of:

sampling a preset sampling number of first spectrum parameter output from said encoder, said first spectrum parameter being related to said sound signal;

sampling a preset sampling number of said reproduced signal;

calculating a second spectrum parameter of which degree is lower than that of said sampled first spectrum parameter;

first filtering for generating a first transfer function having a denominator and a numerator, wherein said first spectrum parameter is included in said denominator and said second spectrum parameter is included in said numerator, and filtering said sampled reproduced signal output from said decoder based on said first transfer function;

adaptively calculating a compensation coefficient based on said sampled first spectrum parameter and said second spectrum parameter; and second filtering for generating a second transfer function based on said compensation coefficient and filtering a signal filtered in said first filtering step based on said second transfer function to obtain a re-filtered signal, wherein said re-filtered signal corresponds to a reproduction of said sound signal.

10. The method of postfiltering of claim 9, wherein said first spectrum parameter and said second spectrum parameter are linear predictive coefficients.

11. The method of postfiltering of claim 9, wherein said first transfer function is of an autoregressive moving average type.

12. The method of postfiltering of claim 9, wherein said second transfer function is of an autoregressive moving average type.

13. The method of postfiltering of claim 9, wherein said step of calculating said second spectrum parameter further comprises the steps of:

converting said first spectrum parameter to preset k parameters;

extracting an arbitrary k parameter from among said k parameters; and converting said extracted k parameter to a second spectrum parameter.

14. The method of postfiltering of claim 9, wherein said step of calculating said compensation coefficient comprises the steps of:

calculating an impulse response of said spectrum postfilter based on said first spectrum parameter and said second spectrum parameter;

calculating a preset autocorrelation function based on said calculated impulse response; and calculating said compensation coefficient based on said calculated autocorrelation function.

15. The method of postfiltering of claim 14, wherein said step of calculating said compensation coefficient is a step of calculating a compensation coefficient from zero degree autocorrelation and one degree autocorrelation.

16. The method of postfiltering of claim 9, comprising a step of calculating said first spectrum parameter from said reproduced signal instead of said step of sampling said first spectrum parameter from said encoder.

17. The postfilter of claim 1, wherein the reproduced signal output by said decoder is based on reception of a signal that corresponds to said sound signal encoded by said encoder.

18. The postfilter of claim 7, wherein the reproduced signal output by said decoder is based on reception of a signal that corresponds to said sound signal encoded by said encoder.

19. The postfilter of claim 8, wherein the reproduced signal output by said decoder is based on reception of a signal that corresponds to said sound signal encoded by said encoder.

20. The method of postfiltering of claim 9, wherein the reproduced signal output by said decoder is based on reception of a signal that corresponds to said sound signal encoded by said encoder.

* * * * *